United States Patent [19]

Walker et al.

[11] 4,304,614

[45] Dec. 8, 1981

[54] ZIRCONIUM HYDRIDE CONTAINING EXPLOSIVE COMPOSITION

[76] Inventors: Franklin E. Walker, 18 Shadow Oak Rd., Danville, Calif. 94526; Richard J. Wasley, 4290 Colgate Way, Livermore, Calif. 94550

[21] Appl. No.: 16,795

[22] Filed: Mar. 2, 1979

Related U.S. Application Data

[63] Continuation-in-part of Ser. No. 610,165, Sep. 4, 1975, Pat. No. 4,196,026.

[51] Int. Cl.[3] ..... C06B 31/28

[52] U.S. Cl. ..... 149/46; 149/87; 149/88; 149/92; 149/93; 149/105; 149/120

[58] Field of Search ..... 149/19.9, 92, 87, 105, 149/88, 120, 46, 93

[56] References Cited

U.S. PATENT DOCUMENTS

| | | | |
|---|---|---|---|
| 3,012,868 | 12/1961 | Hradel | 149/105 |
| 3,035,948 | 5/1962 | Fox | 149/87 |
| 3,646,174 | 2/1972 | Macri | 149/87 |
| 3,704,184 | 11/1972 | Kuehl et al. | 149/2 F |
| 3,728,434 | 4/1973 | Sanders | 149/87 |
| 3,736,194 | 5/1973 | Heller | 149/92 |
| 3,879,504 | 4/1975 | Sherman et al. | 149/93 |
| 3,914,142 | 10/1975 | Sayles | 149/92 |
| 3,953,260 | 4/1976 | Braun et al. | 149/19.9 |
| 4,012,244 | 3/1977 | Kaufman et al. | 149/87 |
| 4,110,135 | 8/1978 | Graham et al. | 149/19.9 |

OTHER PUBLICATIONS

"Military Explosives", Dept. of the Army, TM9-1910, Apr. 1955.

Hawley, "The Condensed Chemical Dictionary", 9th Ed., pp. 51-52, Van Nostrand Reinhold Co. (1977) New York.

*Primary Examiner*—Edward A. Miller

*Attorney, Agent, or Firm*—Michael D. Nelson

[57] ABSTRACT

An improved explosive composition is disclosed and comprises a major portion of an explosive having a detonation velocity between about 1500 and 10,000 meters per second and a minor amount of a donor additive comprising a non-explosive compound or mixture of non-explosive compounds which when subjected to an energy fluence of 1000 calories/cm$^2$ or less is capable of releasing free radicals each having a molecular weight between 1 and 120. Exemplary donor additives are dibasic acids, polyamines and metal hydrides.

2 Claims, No Drawings

ZIRCONIUM HYDRIDE CONTAINING EXPLOSIVE COMPOSITION

RELATED APPLICATIONS

This application is a continuation-in-part of U.S. Ser. No. 610,165 filed Sept. 4, 1975, now U.S. Pat. No. 4,196,026, which is herein incorporated by reference.

BACKGROUND OF THE INVENTION

This invention relates to modifying the explosion performance characteristics of an explosive by doping the explosive with a free radical or ion donor. Typical explosion performance characteristics which may be enhanced include initiation sensitivity, detonation velocity, brisance, etc. It is believed that under ideal conditions, a typical explosion follows the path shown below.

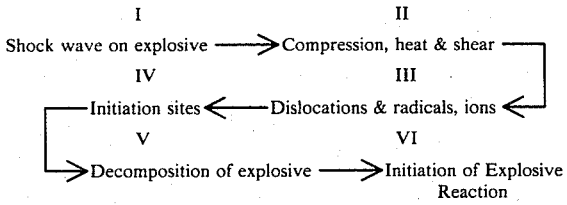

In the first step (I), a shock wave is applied to the explosive either by a mechanical, vibrational, thermal, or electrical shock. The non-explosive additive of the present invention can reduce the amount of shock necessary to initiate the explosion. This is important in formulating explosives since in one embodiment it allows the detonation of an explosive without a primer (detonator) or at least with a smaller or less sensitive primer.

In the second step (II), the explosive undergoes compression, heat and a shear caused from the shock wave. The use of the additive of this invention may be used to release free radicals under milder conditions than would be necessary in order to initiate the explosion.

The third step (III) is the generation of free radicals and/or ions. The doping of the explosive with free radical and/or ion donors, such as by use of the additive of the present invention, allows a control over the number of initiation sites. The number of initiation sites (step IV) affects the rate of detonation. Thus, by using the additives of this invention the detonation velocity and brisance may be modified.

The fifth step (V) is the decomposition of the explosive. This decomposition is a function of time and initiation sites, since the number of initiation sites can be varied by the presence of the additive of this invention, and since the number of initiation sites has an effect upon the number of molecular decompositions, the decomposition time can also be modified by using the additives of the invention.

The sixth step (VI) is the explosive reaction yielding the high energy release. This explosive reaction is a function of the critical initiation energy of the explosive (See UCRL-75722, Apr. 21, 1975, Lawrence Livermore Laboratory report by F. E. Walker and R. J. Wasley). The explosive reaction can also be modified by proper selection of the additive of this invention.

It is an object of this invention to provide an improved explosive composition.

It is another object of this invention to provide an additive which when added to an explosive can enhance the explosion characteristics.

It is a further object of this invention to provide a method for enhancing or modifying the explosion characteristics of an explosive.

Other additional objects will become apparent from the following description of the invention and accompanying claims.

SUMMARY OF THE INVENTION

The aforegoing objects and their attendant advantages can be realized by incorporating into a major portion of an explosive which is capable of being detonated by a mechanical or electrical shock, a minor portion of a donor additive comprising an organic or inorganic compound or mixture of organic and/or inorganic compounds which is (1) capable of releasing low molecular weight free radicals or ions having a molecular weight of 1 to 120 when subjected to an energy fluence of 1000 calories per square centimeter or less and (2) which is not an explosive by itself. Exemplary classes of organic compounds which possess this characteristic are those listed in U.S. patent application Ser. No. 610,165 filed Sept. 4, 1975. Others not listed are $C_2$–$C_{12}$ dibasic acids and $C_2$–$C_{12}$ polyamines. Exemplary classes of inorganic compounds which possess this characteristic include metal hydrides such as, Group I-A metal Hydrides, Group II-A metal hydrides, Group III-A metal hydrides and Group IV-A and B metal hydrides.

We have discovered that the explosion performance characteristics, i.e., initiation sensitivity, detonation velocity, brisance, etc., of an explosive can be conveniently modified by the use of the non-explosive additives of this invention. It is well known that the initiation sensitivity of an explosive is effectively decreased by the addition of a non-explosive diluent. Explosives which detonate under a given set of conditions will generally be less sensitive to detonation upon dilution. However, the additives of this invention, even though such additives act as a diluent, improve the ignition sensitivity of the explosive so that it will detonate under milder conditions.

Although not wishing to be bound to the theory, it is believed that the additives of this invention form low molecular weight free radicals or ions under the initial shock or triggering conditions and assist in initiating the explosive reaction. Regardless of the theory or mechanism involved we have found that the inclusion of the donor additives of this invention to an explosive enhances the explosion performance characteristics.

EXPLOSIVES

Explosives which may be used in the practice of this invention are metastable chemical compounds that are capable of releasing their chemical energy explosively, i.e., in a very short time, from a mechanical, thermal or electrical shock.

As referred to herein "mechanical shock" means any sudden change of pressure on the explosive or shearing of the explosives such as occurs from compression by a hammer or the sudden cutting of the explosive with a sharp blade, or by a vibration, etc. The mechanical shock is one which will initiate the explosive when less then 2000 calories/cm$^2$ and preferably less than 500 calories/cm$^2$ of energy fluence is applied. As referred to herein, "electrical shock" means the application of an electrical charge which transfers less than 2000 calories/cm$^2$ and preferably less than 500 calories/cm$^2$ of energy fluence. The application of this energy will initiate the explosive. The explosives which may be employed typically have a detonation velocity ranging from 1500 to 10,000 meters/sec., and more usually from 2500 to 9,000 meters/sec. Exemplary explosives which can be used in the practice of this invention include the nitro aromatic compounds such as trinitrobenzene (TNB), triamino trinitrobenzene (TATB), diaminotrinitrobenzene (DATB), trinitrotoluene (TNT), trinitroanisole, trinitrocresol, trinitrophenol (picric acid), trinitrophenetol, trinitroresorcinol, trinitromethylaniline, diazodinitrophenol, hexanitrodiphenylamine, hexanitrodiphenyl, diazodinitrophenyl, hexanitrodiphenyl sulfide, hexanitrostilbene (HNS), hexanitrodiphenyl sulfine, hexanitroazobenzene, picryl sulfone, ammonium picrate, guanidine picrate, benzotris oxadiazole trioxide, etc.; the nitramines such as cyclotrimethylenetrinitramine (RDX), trinitrophenylmethylnitramine (Tetryl), cyclotetramethylenetetranitramine (HMX), ethylenedinitramine, nitroguanidine, etc.; nitrosamines such as cyclotrimethylenetrinitrosamine, cyclotetramethylenetetranitrosamine, nitrosoguanidine, etc.; nitric acid esters such as pentaerythritol tetranitrate (PETN), diethanol nitramine dinitrate, nitromannite, nitrostarch, propanetriol trinitrate, diethyleneglycol dinitrate (DEGN), nitrocellulose, nitroisobutyl glycerine trinitrate, tetranitrodiglycerine, nitroglycol, nitrosugars, glycerine chlorohydrin dinitrate, trimethylolethane trinitrate, nitroglycerine, etc.; other nitro compounds such as tetranitro-2,3,5,6, dibenzo-1,3a,4,6a-tetraazapentalene (TACOT), bis trinitroethyladipate, dinitropropyl acrylate, ethyldinitropentanoate, bis (fluoro dinitroethyl) formal, tetranitromethane, nitromethane, amatols, Amatex, etc.; inorganic nitrates such as ammonium nitrate, barium nitrate, Baratol, potassium nitrate, lead nitrate, etc.; inorganic azides such as lead azide, silver azide, copper azide, lead dinitrophenylazide, etc.; and other explosives such as lead styphnate, mercury fulminate, lead picrate, lead salt of dinitrasalicylic acid, tetrazene, lead hypophosphite, etc.

The explosives may be in the form of solids, liquids or gases. They may be used in combinations such as RDX and HMX or individually. Also, liquid explosives may be mixed with solid explosives or gaseous explosives and visa-versa.

Typical detonation velocities are shown in the following table.

TABLE I

Typical Detonation Velocities

| Explosive | Velocity (m/sec) |
|---|---|
| Baratol | 4800 |
| Nitrocellulose (13.45%N) | 7300 |
| Nitroglycerine | 7700 |
| Ammonium nitrate | 4100 |
| Trinitrotoluene | 6930 |
| Picric acid | 7000 |
| Mercury fulminate | 3920 |
| Tetryl | 7850 |
| Ammonium picrate | 6500 |
| Lead azide | 5000 |
| HMX | 9100 |
| RDX | 8700 |
| Diaminotrinitrobenzene | 7520 |
| Pentaerythritol tetranitrate | 8260 |

DONOR ADDITIVES

The donor additives which may be employed in the practice of this invention are organic or inorganic compounds or a mixture thereof capable of releasing low molecular weight free radicals or ions mechanical or electrical shock conditions but which are not explosives. The low molecular weight free radicals or ions will generally have a molecular weight ranging from 1 to 120 and preferably from 1 to 90, and more preferably from 1 to 60. The shock conditions sufficient to cause the donor additive to release free radicals or ions will transfer 1000 calories/cm$^2$ or less of energy fluence and preferably less than 500 calories/cm$^2$ of energy fluence. Compounds capable of releasing low molecular weight free radicals can be determined by subjecting the compounds to an energy fluence of 1000 calories/cm$^2$ and measuring for the existence of free radicals. This may be done by continual ESR and NMR techniques as well as other detection methods. Depending upon the desired properties, a donor additive capable of forming multiple free radicals or ions can be highly advantageous. Additives which may be employed to vary the explosion performance characteristics include the following.

I: Organic nitrates having from 2–12 carbons and preferably having no carbon-carbon chain longer than 7 carbon atoms and more preferably 4 carbons. Examples of suitable nitrates include tetraalkyl ammonium nitrate, such as tetramethyl ammonium nitrate, tetraethyl ammonium nitrate, tetrapropyl ammonium nitrate, trimethylethyl ammonium nitrate, etc,; hydrocarbyl nitrates such as butylnitrate, isobutyl nitrate, etc.; tetraalkyl phosphonium nitrates such as tetramethyl phosphonium nitrate, tetraethyl phosphonium nitrate, etc.

II: Organic peroxides having from 4 to 14 and preferably from 4 to 8 carbons. Exemplary peroxides which may be employed include dibenzoyl peroxide, methylethyl ketone peroxide, acetyl peroxide, propionyl peroxide, ethanyl peroxide, etc.

III: Hydrocarbyl amines having from 1 to 10 carbons (preferably 1 to 6 carbons) and may be primary, secondary or tertiary with tertiary amines being preferred. Exemplary amines are ethyl amine, diethyl amine, triethyl amine, propyl amine, dipropyl amine, tripropylamine, etc. The particularly preferred hydrocarbyl amines have hydrocarbyl groups not exceeding 3 carbons in any chain.

IV: Organic and inorganic persulfates. Exemplary inorganic persulfates include ammonium persulfates and alkali metal persulfates such as lithium persulfate, sodium persulfate, and potassium persulfate, etc. The C4-C12 tetraalkyl-ammonium persulfates may also be employed, such as tetramethyl ammonium persulfate, tetraethyl ammonium persulfate, etc.

V: Organic boron compounds having from 1 to 20 carbons and preferably having no carbon-carbon chains longer than 7 carbon atoms (more preferably no longer than 4 carbons). Exemplary boron compounds which may be employed include hydrocarbyl borohydrides such as dimethyl borohydride, methyl diborohydride, tetramethyl diborohydride, dibenzyl borohydride, dibutylborohydride, dimethyl borohydride, trimethyl diborohydride, etc. The ammonium borohydrides such as tetraethyl ammonium borohydride, tetramethyl ammonium borohydride, tetramethyl ammonium triborohydride, tetraethyl ammonium triborohydride, tetramethyl ammonium diborohydride, tetraethyl ammonium diborohydride, diethyl dimethyl borohydride, etc.

The amino borines such as methyl triborinetriamine (N), tetramethyl triborine triamine (N-B-B1-B11), trimethylammino borine, trimethyl triborine triamine (B), methylborine trimethylammine, methyl triborine triamine (B), dimethyl triborine triamines, triphenyl borine amine, etc.; the hydrocarbyl borines such as tribenzyl borine, triphenyl borine, tributyl borine, tripropyl borine, trimethyl borine, etc.; the boron oxides such as tributyl triborine trioxane, trihexyl triborine trioxane, trimethyl triborine trioxane, etc. The multiple boro compounds, e.g., di, tri, tetra, etc., are preferred and particularly the tri, tetra and penta boro compounds.

VI: Hydrocarbyl aldehydes having from 1 to 7 carbons (preferably 2 to 4 carbons) such as acetaldehyde, propionaldehyde, benzaldehyde, butyraldehyde, etc.

VII: Organic azo compounds having from 2 to 16 carbons and preferably having no carbon-to-carbon chain longer than 7 carbons (preferably no longer than 4 carbons). Exemplary azo compounds include axobenzene, p-acetamidoazobenzene, azo propane, diazomethane, benzene diazoanilide, diazo aminobenzene, ethane azobenzene, methane azobenzene, benzene diazonium tribromide, diazoethane, etc.

VIII: Hydrocarbyl monhalides having from 0 to 10 carbons and perferably from 2 to 5 carbons. Exemplary compounds include methyl chloride, methyl bromide, ethyl chloride, ethyl bromide, probyl bromide, ethyl iodide, propyl iodide, butyl bromide, pentyl bromide, etc. The preferred hydrocarbl monhalides are the hydrocarbyl bromides.

IX: Quinones and hydroquinones having from 6 to 10 carbons such as quinone, benzoquinone dioxime, dichlorobenzoquinone, dimethyl quinone, methyl quinone, nitroquinone, tetrahydroxyquinone, hydroquinone, bromohydroquinone, dithiohydroquinone, methyl hydroquinone, tetrachlorohydroquinone, etc.

X: Organic dibasic acides having from 2 to 12 carbons and preferably from 2 to 10 carbons. Exemplary dibasic acides include adipic acid, succinic acid, phathalic acid, malonic acid, etc.

XI: Organic polyamines having from 2 to 12 carbons and preferably from 2 to 8 carbon atoms. The polyamines will usually have from 2 to 6 amine groups and preferably from 2 to 4 amine groups. Exemplary polyamines include ethylene diamine, diethylene triamine, propylene diamine, dipropylene triamine, triethylene tetraamine, etc.

XII: Metal hydrides. Exemplary metal hydrides include Group I-A metal hydrides such as sodium hydride, potassium hydride, lithium hydride, etc. Group II-A metal hydrides such as beryllium hydride, magnesium hydride, calcium hydride, etc. Group III-A metal hydrides such as aluminum hydride, gallium hydride, etc., and Group IV-A and B metal hydrides such as titanium hydride, zirconium hydride, germanium hydride, etc.

As referred to herein, hydrocarbyl is a monovalent organic radical composed mostly of hydrogen and carbon and may be aliphatic, aromatic, or alicyclic or combinations thereof, e.g., aralkyl, alkyl, aryl, cycloalkyl, alkyl, cycloalkyl, etc., and may be saturated or ethylenically unsaturated. The preferred hydrocarbyl is alkyl. Various functional groups may be present on or in the hydrocarbyl chain or within the organic compounds, and may be a wide range of univalent or multivalent radicals such as halo, carbonyl, amino, amido, mononitro, oxy, alkoxy, epoxy, carboxy, carboxyl, sulfoxy, nitrilo, hydrazino, mercapto, nitroso, sulfino, sulfonyl, sulfo, ureido, etc.

PREPARATION

The composition of this invention can be prepared by simple admixture of the explosive and the donor additive. The donor additive may be solid, liquid or gaseous. In the event of a solid, the donor additive should preferably be pulverized or otherwise rendered into a powder form and intimately mixed with the explosive. The explosive-additive mixture may then be used directly or slurried, pressed, cast, gelled, extruded, plasticized, pelletized, etc. In one embodiment of the invention, the donor additive is admixed with only a portion of the explosive. In this embodiment the mixed portion may function as a detonator or as a shaped charge. It should be recognized that many methods of preparation and design may be utilized within the scope of the present invention.

In the event the donor additive is a liquid, it can be incorporated into the explosive in the same manner as discussed above. If the explosive is a solid, then a paste or slurry of the explosive and donor additive may be made. If the explosive is also a liquid, the two may be used as a liquid mixture or incorporated into a solid support. Alternatively, the mixture may be thickened into a gel. In another embodiment, the mixture is polymerized into a polymeric matrix. In this embodiment it may be necessary with some of the additives, to add them after polymization.

In the event the donor additive is a gas, the explosive may be used in the gaseous state. Alternatively, the donor gas may be dissolved in a carrier liquid or in the explosive. In still another embodiment, a gas precursor may be employed which releases the gaseous donor additive prior to use or detonation.

The amount of donor additive which can be employed in the practice of this invention may vary over a wide range depending upon the type of explosives involved, the type of donor additives selected, etc. Generally, however, the donor additive will be present in an amount from 0.01 to 20 percent by weight of the final explosive and preferably will be present in an amount from 0.2 to 10 weight precent.

The weight ratio of donor additive to explosive will generally vary from 0.01–20 weight parts of donor additives for each 100 weight parts of explosive and preferably from 0.2 to 10 weight parts of donor additive for each 100 weight parts of explosive.

It should be recognized that precursors of the donor additives may be prepared and added to the explosive and such precursors are included within the scope and spirit of this invention. It is also recognized that compounds other than the classes specifically set forth in the specification may be employed provided such compounds release low molecular weight free radical or ions under shock conditions and are not explosives themselves. An additive is classified as a non-explosive if it cannot be detonated by a strong mechanical shock and has a detonation velocity below 1500 meters per second. A strong mechanical shock is that which transfers not less than 2500 calories/cm$^2$ of energy fluence.

OTHER ADDITIVES

In addition to the free radical or ion donor additive of this invention, other additives may be present without adversely affecting the donor's performance properties. Exemplary additives include oxidizers such as metallic nitrates, e.g., such as sodium and potassium nitrate, etc.; swelling agents such as guar flour, cellulose, carboxymethyl cellulose, etc; powdered metals such as aluminum, magnesium, zirconium, titanium, etc; polymers such as vinyl, acrylic and alkylene oxide polymers, PVA, polyacrylamide, etc.; alkali metal azides such as sodium and potassium azide, etc.; water; carbonaceous materials such as powdered coal, fuel oil, coal dust, charcoal, wood meal, etc.; glass powder, and others.

The amount of other additives which may be employed may vary over a wide range depending upon the type of additive employed, the purpose, the type of explosive, etc. Generally, however, the other additives above listed will be present in an amount varying from 0 to 60 percent but usually varying from 0.1 to 30 percent and more usually varying from 1 to 20 percent by weight of the total composition.

USES

The explosive compositions of this invention can be used in a wide varitey of applications. They may be used in typical demolition and blasting activities, in well fracturing (See U.S. Pat. No. 3,825,452), in making molded explosives of varying detonation speeds (See U.S. Pat. No. 3,619,306), in generating gases such as nitrogen for use in dynamic lasers (See U.S. Pat. No. 3,773,947), or for use in automobile crash bags (See U.S. Pat. No. 3,785,674), in making rocket fuels (See U.S. Pat. No. 3,804,683), in making ammunition (See U.S. Pat. No. 2,111,203), in making fuses (See U.S. Pat. No. 3,421,441), in welding (See U.S. Pat. No. 3,676,234), in bombs and many other applications.

The following examples are presented to illustrate the practice of specific embodiments of this invention and should not be interpreted as limitations upon the scope of the invention.

EXAMPLE I

This example is presented to illustrate the initiation sensitivity of an explosive. In this test a compression wave of varying strengths is applied to a sample explosive by impacting a weight against the sample until the explosive detonates. This test is typically called the drop hammer test. The drop hammer test is more fully described in the Manual for Sensitiveness Tests, TTCP Panel 0-2, February, 1966, Canadian Armanent Research and Development Report. Briefly, a 2.5 kilogram hammer is guided to various heights above a $1\frac{1}{8}$ inch diameter 10 inch high cylindrical steel striking pin (2.5 kilograms in weight). The striking pin rests on the sample explosive which in turn rests on a hardened steel anvil.

The test sample of approximately 35 mg. is placed on 80-100 mesh sand paper which rests on the anvil and the striking pin is gently pressed down upon the sample. The hammer is dropped from a given height onto the striking pin. If no explosion occurs, the test is repeated with a fresh sample from successively greater heights until an explosion occurs. If an explosion occurs, a fresh sample is replaced in the test machine and tested at successively lower heights until a point of no explosion is reached. Thereafter, a sample is tested at a given increment below the level at which the previous sample was tested if that sample exploded and at a given increment above the lever at which the previous one was tested if it did not explode. By using this up-and-down method and analyzing the data statistically, a height for 50% ignition probability is attained. The procedure for determining this height and the error at a 95% confidence level is discussed by W. J. Dixon and A. M. Mood, "Method of Obtaining and Analyzing Sensitivity Data", *Journal American Stat. Assoc.*, Vol. 43, 1948, pp. 109-126, which is herein incorporated by reference.

A microphone is mounted on the anvil face and the signal from the microphone is fed to an amplifier which in turn triggers an thyratron tube. Triggering the thyratron tube lights a neon lamp on the panel. This indicates whether the sample explosive exploded.

The following table illustrates the ignition sensivitity for various commercial explosives.

TABLE II

| Explosive | Drop Hammer Weight |
|---|---|
| Trinitrotoluene (TNT) | 100 cm. |
| Cyclotetramethylene tetranitramine (HMX) | 39 cm. |

EXAMPLE 2

This example illustrates the desensitizing effect of a non-explosive diluent on the ignition sensitivity. An approximate 2 gram portion of TNT is added to a small 50 cc glass bottle and about 100 milligrams of benzoic acid are added. The bottle is tumbled for about 10 minutes to uniformly mix the explosive with the diluent. Thereafter, successive 35 milligram portions of the mixture are tested in the drop hammer test. The results show that the addition of 5 percent of a diluent increased the drop hammer height to about 145 cm.

EXAMPLE 3

This example is presented to illustrate that mixtures of explosives do not automatically change the ignition sensitivity. The same procedure as discussed in Example 2 is followed except that 5 percent of HMX is mixed with 95 percent of TNT. The sample exploded at about 100 cm.

EXAMPLE 4

This procedure of example 2 is repeated except that phthalic anhydride diluent is used instead of benzoic acid. The sample of 95 percent TNT and 5 percent phthalic anhydride exploded at about 145 cm.

EXAMPLE 5

This example is presented to illustrate the improvement in ignition sensitivity, by the addition of a non-explosive free radical or ion donor to the explosive. In this test, approximately 2 grams of TNT fine powder are placed in a 50 cc glass bottle along with about 100 milligrams of ammonium persulfate powder. The bottle is tumbled for about 10 minutes to uniformly mix the explosive with the additive. Next, successive 35 mg. portions of the mixture are tested in the drop hammer apparatus. The results show that the explosive/additive mixture exploded at drop height of 80 cm. Since the ammonium persulfate does not explode at any height in the drop hammer test, it is a diluent to the explosive. Thus, the use of the additive is this invention increased the sensitivity from 145 cm. to 80 cm.

EXAMPLE 6

The procedure of Example 5 is repeated except that quinone is used in place of ammonium persulfate. The explosive mixture exploded at 77 cm.

EXAMPLE 7

The procedure of Example 5 is repeated except that hydroquinone is used in place of ammonium persulfate. The explosive mixture exploded at 125 cm.

EXAMPLE 8

The procedure of Example 5 is repeated except that tetramethyl ammonium nitrate is used in place of ammonium persulfate. The explosive mixture exploded at 130 cm.

EXAMPLE 9

The procedure of Example 5 is repeated except that triethylamine is used in place of ammonium persulfate. The explosive mixture exploded at 88 cm.

EXAMPLE 10

The procedure of Example 5 is repeated except that tetraethyl ammonium borohydride is used in place of ammonium persulfate. The explosive mixture exploded at 133 cm.

EXAMPLE 11

The procedure of Example 5 is repeated except that azobenzene is used in place of ammonium persulfate. The explosive mixture exploded at 90 cm.

EXAMPLE 12

The procedure of Example 5 is repeated except that tetramethyl ammonium triborohydride is used in place of ammonium persulfate. The explosive mixture exploded at 44 cm.

EXAMPLE 13

The procedure of Example 5 is repeated except that dibenzyl peroxide is used in place of ammonium persulfate. The explosive mixture exploded at 122 cm.

EXAMPLE 14

In this test, approximately 2 grams of TNT powder are placed in a 50 cc glass bottle along with about 100 milligrams of ethylbromide liquid. The bottle is tumbled for about 10 minutes to uniformly disperse the ethylbromide within the TNT. Thereafter, successive 35 mg. portions of the mixture are tested in the drop hammer device. The mixture exploded at 62 cm.

EXAMPLE 15

The procedure of Example 14 is repeated except that acetaldenhyde liquid is used in place of the ethylbromide. The mixture exploded at 90 cm.

EXAMPLE 16

The procedure of example 14 is repeated except that a liquid diluent is used in place of the ethylbromide. The liquid diluent is water. The mixture exploded at 116 cm.

TABLE III

| | | Drop Hammer Test | |
|---|---|---|---|
| Example | Explosive | Additive* | Height (cm.) |
| 1 | TNT | None | 100 |
| 2 | TNT | Solid diluent** | 145 |
| 3 | TNT & HMX | None | 100 |
| 4 | TNT | Solid diluent*** | 145 |
| 5 | TNT | Ammonium persulfate | 80 |
| 6 | TNT | Quinone | 77 |
| 7 | TNT | Hydroquinone | 125 |
| 8 | TNT | T.M.A.N.* | 130 |
| 9 | TNT | Triethylamine | 88 |
| 10 | TNT | T.E.A.B.* | 133 |
| 11 | TNT | Azobenzene | 90 |
| 12 | TNT | T.M.A.T.B.* | 44 |
| 13 | TNT | Dibenzyl peroxide | 122 |
| 14 | TNT | Ethylbromide | 62 |
| 15 | TNT | Acetaldehyde | 90 |
| 16 | TNT | Liquid diluent**** | 116 |

*T.M.A.N. is tetramethyl ammonium nitrate
*T.E.A.B. is tetraethyl ammonium borohydride
*T.M.A.T.B. is tetramethyl ammonium triborohydride
**Solid diluent is benzoic acid
***Solid diluent is phthalic anhydride
****Liquid diluent is water The above table illustrates an improvement in the detonation sensitivity of the various additives over a sample with an equal amount of diluent.

We claim:

1. A composition of matter comprising a major portion of a metastable explosive capable of being detonated by a mechanical, electrical or thermal shock and having a detonation velocity between about 1,500 and 10,000 meters per second and from 0.2 to 10 weight percent of zirconium hydride and wherein said composition of matter being an explosive having a sensitivity greater than the sensitivity of said metastable explosive.

2. The explosive defined in claim 1 wherein said explosive is selected from trinitrotoluene, cyclotrimethylenetrinitramine, trinitrophenylmethylnitramine, triamino trinitrobenzene, pentaerythritol tetranitrate, diaminotrinitrobenzene, ammonium nitrate, nitroguanidine and diethyleneglycol dinitrate.

* * * * *